United States Patent [19]

Liebscher et al.

[11] 4,135,415

[45] Jan. 23, 1979

[54] CORKSCREW

[75] Inventors: Johannes Liebscher, Nassau (Lahn); Rolf G. Schülein, Singhofen, both of Fed. Rep. of Germany

[73] Assignee: Leifheit International Gunter Leifheit GmbH, Nassau (Lahn), Fed. Rep. of Germany

[21] Appl. No.: 807,752

[22] Filed: Jun. 17, 1977

[30] Foreign Application Priority Data

Jun. 24, 1976 [DE] Fed. Rep. of Germany ..... 2628352

[51] Int. Cl.[2] ..... B67B 7/00

[52] U.S. Cl. ..... 81/3.38 A; D8/42

[58] Field of Search ..... D8/42; 81/3.1 A, 3.34, 81/3.35, 3.36, 3.37, 3.38 R, 3.38 A, 3.45, 3.46 R, 3.46 A, 3.47, 3.48, 3.49

[56] References Cited

U.S. PATENT DOCUMENTS

| | | | |
|---|---|---|---|
| D. 146,833 | 5/1947 | Peterson | D8/42 |
| 515,658 | 2/1894 | Crellin | 81/3.38 A |
| 1,200,079 | 10/1916 | Christensen et al. | 81/3.35 |

FOREIGN PATENT DOCUMENTS

| | | | |
|---|---|---|---|
| 554099 | 1/1957 | Belgium | 81/3.38 R |
| 60662 | 1/1892 | Fed. Rep. of Germany | 81/3.38 R |
| 715085 | 11/1931 | France | 81/3.38 R |
| 201 of | 1897 | United Kingdom | 81/3.38 R |
| 1188579 | 4/1970 | United Kingdom | 81/3.45 |

*Primary Examiner*—Al Lawrence Smith
*Assistant Examiner*—James G. Smith
*Attorney, Agent, or Firm*—Michael J. Striker

[57] ABSTRACT

A corkscrew includes a support consisting of a supporting ring adapted to engage a neck of a bottle, and a support bracket connected to the supporting ring. An elongated spindle having a cork-engaging helix at its leading end and a threaded portion at its trailing end is mounted on the support for turning relative thereto and also for longitudinal displacement. A nut engages the threaded portion of the spindle and has handgrip portions, and a locking element embraces the nut and is pivotable relative thereto between a locking position in which it connects the nut to the spindle for joint turning and longitudinal displacement, and an unlocking position in which it releases the spindle for longitudinal displacement during the further turning of the nut. The locking element has an actuating portion which engages an abutment surface of the support when the helix has penetrated into a cork to the desired extent, the engagement of the actuating portion with the surface pivoting the locking element into its unlocking position whereupon the cork is drawn out of the bottle. A biasing arrangement, such as a torsion spring, is interposed between the nut and the locking element, urging the latter towards its locking position. The supporting ring has an elastic lining which contacts the neck of the bottle.

13 Claims, 6 Drawing Figures

CORKSCREW

BACKGROUND OF THE INVENTION

The present invention relates to corkscrews in general, and more particularly to that type of corkscrews which are supported on the neck of the bottle both during the threading of a cork-engaging helix into a cork, and during extraction of the cork from the neck of the bottle.

There is already known a corkscrew which includes a spindle the trailing end of which is provided with an external thread and the leading end of which is formed with a cork-engaging helix, a nut which embraces the threaded portion of the spindle and having radially projecting opposite projections which constitute a handgrip of the nut, a locking member which embraces the nut, is pivotable about a pivot axis transverse to the longitudinal axis of the spindle, and has a bore which, in the unlocking position of the locking element, releases the spindle, and a bracket or support which is displaceable longitudinally of the spindle and adapted to pivot the locking element into its unlocking position, such support having legs which are interconnected by means of a supporting ring resting on a neck of the respective bottle.

In a heretofore proposed corkscrew of this type, the locking element has a center of gravity which is spaced from the pivot axis thereof so that the locking element which is pivotally mounted on the nut is juxtaposed, in the region of the actuating portion thereof, with the threaded portion of the spindle in such a manner that its abutment wall overlaps the free end of the threaded portion of the spindle. In this locking position of the locking member relative to the spindle, the bore which permits the free passage of the spindle out of the locking member is in an ineffective position, that is, it is pivoted into a position in which it extends transversely of the longitudinal axis of the spindle. Now, when the nut having the handgrip is turned about the longitudinal axis of the spindle, the entire spindle is also turned about its longitudinal axis as a result of the engagement of the free end of the spindle with the above-mentioned abutment wall of the locking element, so that the helix at the leading end of the spindle can be threaded into a cork. During this turning, the bracket or support which displaceably surrounds the spindle, contacts the neck of the bottle with its supporting ring. When the cork-engaging helix penetrates into the cork to the desired extent, the support, which moves relative to the spindle during the turning of the latter longitudinally thereof, engages with its abutment surface the actuating portion of the locking element and, during further turning of the nut, pivots the locking element about its pivot axis through about 90°. As a result of the pivoting of the locking element, the bore of the latter reaches a position in which it is coaxial with the spindle and arranged in registry with the free trailing end thereof, so that the spindle can emerge out of the locking element through this bore. As soon as the trailing end of the spindle is no longer confined by the locking element, the spindle is only longitudinally displaced during the further rotation of the nut, without rotating. During such axial displacement of the spindle, the cork is extracted from the neck of the respective bottle which rests against the supporting ring.

Experience with this conventional corkscrew has shown that the penetration of the helix of the spindle into the cork, during the first phase of operation of the corkscrew, is only possible when the bottle and the corkscrew are arranged in a vertical position, the corkscrew being arranged upwardly of the bottle. On the other hand, when the bottle and the corkscrew assume a position which deviates from the vertical, the locking element assumes a position inclined relative to the longitudinal axis of the spindle so that the bore of the locking element sets the trailing end of the spindle free for displacement relative to the nut. Now, when the handgrip of the nut is actuated in such a position of the locking element, the helix at the leading end of the spindle cannot be threaded into the cork, but rather the spindle moves through the bore of the locking element and emerges out of the same so that the corkscrew is incapable of performing its function.

In addition thereto, the conventional corkscrew of this type includes a metallic bracket which is either made of bent wire, or is manufactured in an injection molding procedure. In order to, on the one hand, protect such metallic brackets from corrosion and, on the other hand, give such metallic brackets an aesthetically pleasing appearance, the exposed surfaces of such metallic brackets are provided with a coating of chromium, nickel or the like. The manufacture of such metallic brackets is expensive both in terms of labor and capital investment.

SUMMARY OF THE INVENTION

Accordingly, it is a general object of the present invention to avoid the disadvantages of the prior art.

More particularly it is an object of the present invention to develop a corkscrew which is not possessed of the disadvantages of the prior-art corkscrews.

Yet more particularly, it is an object of the present invention to so design a novel corkscrew that it can be manufactured of inexpensive materials and requiring only a minimum amount of such materials.

A concomitant object of the present invention is to provide a corkscrew which is simple in construction, reliable in operation, and inexpensive to manufacture nevertheless. A further object of the present invention is to so construct the novel corkscrew as to be fully functional even when used in a position deviating from the vertical.

In pursuance of these objects and others which will become apparent hereafter, one feature of the present invention resides, briefly stated, in a corkscrew which comprises, in combination, an elongated spindle having a longitudinal axis, a cork-engaging helix at the leading end portion, and a thread at a trailing end portion thereof; means for supporting said spindle on a respective container for turning about said longitudinal axis and for displacement longitudinally thereof between a retracted and an extended position, including a support having an abutment surface; a threaded member having engaging portions which engage said thread of said spindle; means for turning said threaded member about said longitudinal axis; a locking element mounted on said threaded member for pivoting relative thereto about a pivoting axis normal to said longitudinal axis between a locking position in which it connects said threaded member to said spindle for joint turning and displacement toward said extended position, and an unlocking position in which it releases said spindle for displacement relative to said threaded member toward said retracted position, and having an actuating portion which engages said abutment surface of said support as said spindle approaches said extended position thereof to pivot said locking element from said locking to said unlocking position; and biasing means urging said locking element toward said locking position thereof.

As a result of the provision of the biasing means, it is achieved that the locking element always connects the nut to the spindle during the first phase of the operation of the corkscrew, independently of the position of the bottle and of the corkscrew, which may deviate from the vertical, inasmuch as the biasing means does not permit the locking element to pivot into its unlocking position as a result of gravitational forces acting on the locking element. As a result of this, the connection between the nut and the spindle, via the locking element which overlaps the free trailing end of the spindle, is maintained for so long until the locking element is pivoting in its unlocking position by the abutment of the abutment surface of the support against the actuating portion of the locking element, whereby the bore which is provided in the locking element assumes such a position that the spindle can emerge from the interior of the locking element to the exterior thereof through such bore.

In a currently preferred embodiment of the present invention, the thread is an external thread and the threaded member is a nut which surrounds the trailing end portion of the spindle, and the turning means includes a pair of projections which extend radially outwardly from said nut at opposite sides thereof. Then, the biasing means is arranged between said locking element and at least one of said projections.

In order to be able to arrange the biasing means, in a space-saving manner, between the turning projections and the locking element, the biasing means is constituted by a helical torsion spring which has one end connected to said locking element and another end connected to said one projection. Under these circumstances, the spindle, the locking element and the torsion spring can be assembled in an especially simple manner when, according to a further preferred aspect of the present invention, said one projection includes a core element rigid with said nut and a sleeve surrounding said core element and rigidly connected thereto, and the above-mentioned other end of said torsion spring is attached to said sleeve.

In order to be able to manufacture the corkscrew in such a manner as to consume only a minimum amount of material, it is further advantageous when the support which is longitudinally displaceably mounted on the spindle is of a substantially U-shaped configuration, having a bight and two legs which extend from said bight toward said one end portion of said spindle, the supporting means forther including a supporting ring adapted to engage the respective container and mounted on free ends of said legs which are remote from said bight. Preferably, said support is tubular and said free ends of said legs have receiving openings for partly receiving said supporting ring. A connection between the supporting ring and the support which does not require any additional connecting means can be achieved when the supporting ring is substantially U-shaped in longitudinal section, having arms which are press-fittingly received in said receiving openings.

In order to achieve the above-mentioned press-fitting connection, it is further proposed, according to another aspect of the present invention, to provide said arms with ribs at their respective circumferences which are juxtaposed with said free ends of said legs within said receiving openings. Preferably, the arms are elongated and the ribs extend longitudinally of the arms. As a result of the provision of the longitudinal ribs, the overall cross-section of the arms is somewhat greater than the cross-section of the receiving openings provided in the legs. When the arms are introduced into the receiving openings of the legs, the pressure fit between the arms of the supporting ring and the legs of the support is increased by the elastic deformation of the longitudinal ribs and a permanent connection is obtained between the support and the supporting ring.

In order to be able to distribute the reaction force resulting from the extraction of the cork from the bottle neck, as uniformly as possible over as great an area of the bottle neck as possible, it is further proposed, according to a further facet of the present invention, to construct the supporting ring of a supporting body and an elastic ring which is mounted on said supporting body and adapted to contact the respective container. The elastic ring can be connected in a simple manner and reliably with the supporting body, when the latter has an inner surface which bounds an opening having a smaller cross-section remote from than at that face of said supporting body which faces the respective container. Then, the elastic ring rests against said surface at the region of the smaller cross-section of said opening.

Preferably, the elastic ring has a passage conically converging away from said face and adapted to embrace the neck of the respective bottle or container, the smallest cross-section of such passage being smaller than that of the neck. Advantageously, the smallest cross-section of said passage approximately corresponds to the smaller cross-section of the opening in the supporting body.

To advantage, the supporting body has at least one recess in said opening, and the elastic ring has at least one elastically yieldable tongue engaging in said recess, preferably two such tongues which are diametrally opposite to one another. These elastically yieldable tongues provided on the periphery of the elastic ring hold the latter in the supporting body, in that these tongues engage in the recess or recesses which extend to a greater diameter than that of the larger cross-section of said opening.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is a fragmentary sectional view taken on line IV—IV of FIG. 3*a.

DESCRIPTION OF THE PREFERRED EMBODIMENTS

Figure 1:
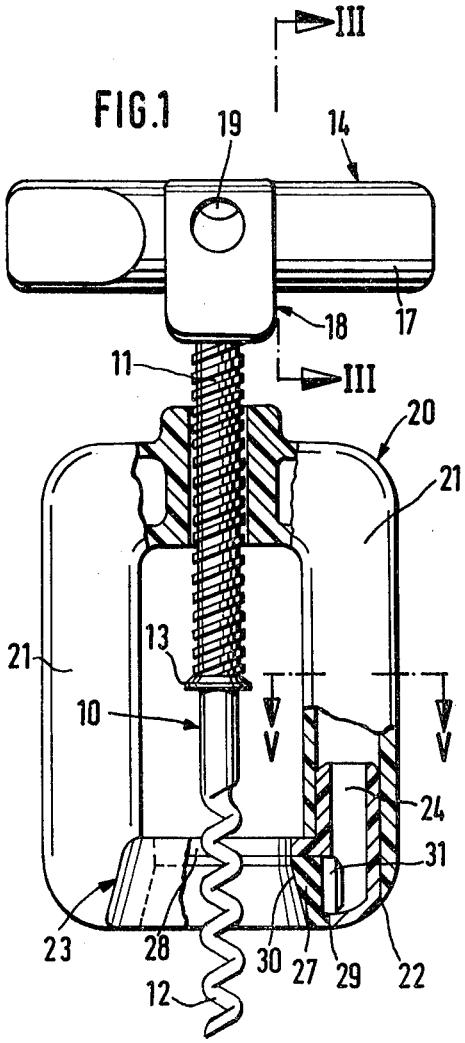
FIG. 1 is a partly sectioned front elevational view of a corkscrew according to the present invention.
Figure 2:
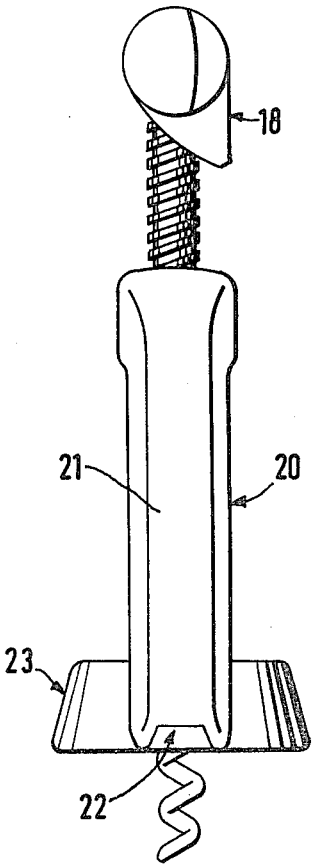
FIG. 2 is a side elevational view of the corkscrew of FIG. 1.

Referring now to the drawing in detail, and first to FIGS. 1 and 2 thereof, it may be seen therein that the corkscrew of the present invention includes a spindle 10 which has a trailing end portion 11 formed with an external thread, and a leading end portion 12 which is configurated as a helix, a screw, or another cork-engaging and cork-penetrating formation. A disk 13 is rigidly connected to the spindle 10, the disk 13 serving as an abutment and separating the trailing end portion 11 from the leading end portion 12. This abutment disk 13 avoids the possibility that a support 20 which is mounted on the spindle 10 for displacement axially thereof, could slide off the leading end portion 12 of the spindle 10.

The support 20 has the shape of a rectangular annulus, whose upper bight as illustrated in the drawing is provided with an opening which surrounds the threaded trailing end portion 11 of the spindle 10. The lower link of the support 20 is configurated as a supporting ring 23 which has an opening 30 serving for supporting the support 20 on a neck of a respective container.

Figure 4:
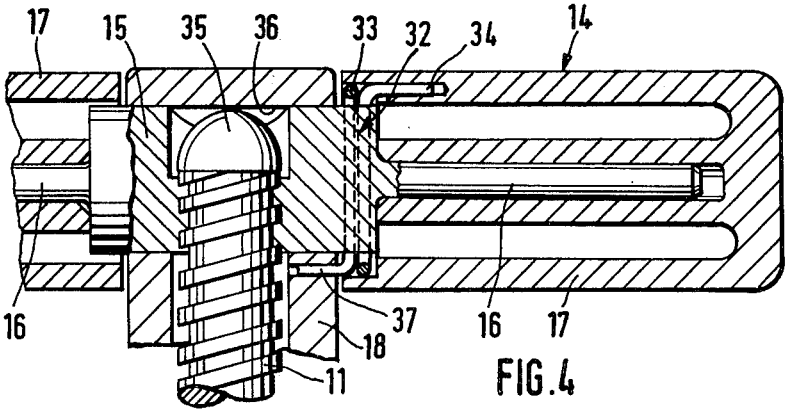

As best seen in FIG. 4, a nut 15 is threaded onto the threaded end portion 11 of the spindle 10. The nut 15 is formed with bolt-shaped projections 16 which extend transversely of the longitudinal axis of the thread of the nut 15 to mutually opposite sides of the latter. As viewed in the longitudinal direction of the projections 16, the nut 15 has a cylindrical cross-section, the axis of such cross-section coinciding with the longitudinal axes of the projections 16. A depression is arranged at the upper side of the nut 15 coaxially with the thread of the trailing end portion 11 of the spindle, such depression being adapted to receive a semi-spherical end section 35 of the trialing end portion 11 of the spindle 10.

A locking element 18 is pivotally mounted on the nut 15, having an actuating portion which, in its stable position, is in contact with the threaded trailing portion 11 of the spindle 10. For this reason, the actuating portion is formed with a depression in which a portion of the threaded trailing end portion 11 of the spindle 10 is received.

Figure 3A:
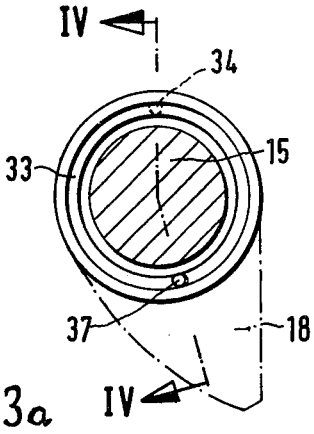
FIG. 3*a* is a section taken on line III—III of FIG. 1 with a locking member, illustrated in phantom lines, in its locking position.

As seen in FIG. 1, a bore 19 is provided in the locking element 18, the longitudinal axis of the bore 19 assuming a substantially horizontal position when the locking element 18 is in its stable position illustrated in FIG. 3*a*. In this locking position of the locking element 18, an abutment wall 36 of the locking element 18 overlaps the semi-spherical end 35 provided at the trailing end portion 11 of the spindle 10. On the other hand, when the locking member 18 is in its upwardly pivoted position illustrated in FIG. 3*b*, the longitudinal axis of the bore 19 in the locking element 18 extends in the vertical direction and coincides with the longitudinal axis of the spindle 10. In the last-mentioned position of the locking element 18, the trailing end portion 11 of the spindle 10 can emerge out of the interior of the locking element 18 through the bore 19 provided in the locking element 18.

The projections 16 which are rigidly connected with the nut 15 constitute a handgrip 14 proper. In order to be able to hold the locking element 18 which is pivotably mounted on the nut 15 in its locking position in which it contacts the threaded trailing end portion 11 of the spindle 10, against the influence of a torque which results from the fact that the center of gravity of the locking element 18 is spaced from the pivoting axis of the locking element 18, a biasing arrangement 32 is arranged between the locking element 18 and the nut 15 or one of the projections 16 of the latter. The force exerted by the biasing arrangement 32 on the locking element 18 is so selected that the torque resulting from such force is somewhat greater than the above-mentioned torque resulting from the influence of gravity on the mass of the locking element 18.

In the embodiment of the present invention which is illustrated in FIG. 4, the biasing arrangement 32 includes a helical torsion spring 33, one end 34 of which is connected to a handgrip sleeve 17 rigidly connected with the projection 16, while another end 37 of the helical torsion spring 33 engages in a bore provided in an end face of the locking element 18.

At the outset of the operation of the corkscrew, that is, during a first phase thereof, the locking element 18 assumes the position illustrated in FIGS. 1, 2 and 3*a*, and the actuating portion thereof is pressed by the helical torsion spring 33 against the threaded trailing end portion 11 of the spindle 10. The locking element 18 maintains this position even when the longitudinal axis of the spindle 10 of the corkscrew encloses an angle with the vertical. In this locking position of the locking element 18, the abutment wall 36 thereof overlaps the semi-spherical end 35 provided at the trailing end portion 11 of the spindle 10 so that, when the handgrip 14 is turned about the longitudinal axis of the spindle 10, the threaded trailing end portion 11 of the spindle 10 and the nut 15 are clamped with one another. As a result of this, it is possible to transmit a torque which is applied to the handgrip 14 to the leading end portion 12 of the spindle 10, so that the latter can be threaded into a cork.

Due to its own weight, the support 20 which is mounted on the trailing end portion 11 of the spindle 10 for displacement relative thereto, and particularly the supporting ring 23, rest on the neck of the bottle or a similar container. During the turning of the spindle 10, the neck of the bottle displaces the support 20 relative to the spindle 10 along the leading end portion 12 of the spindle 10 during the penetration of the leading end portion 12 into the cork.

Figure 3B:
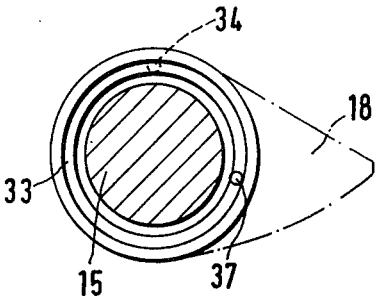
FIG. 3*b* is a view similar to FIG. 3*a* but with the locking member in its unlocking position.

Finally, when the leading end portion 12 of the spindle 10 has penetrated into the cork to the desired extent, the upper abutment surface of the support 20 comes into contact with the actuating portion of the locking element 18 and pivots the latter, against the force of the helical torsion spring 33, into the position which is illustrated in FIG. 3*b*. Simultaneously with the pivoting of the locking element 18, the bore 19 in the latter is also pivoted until the longitudinal axis thereof coincides with the longitudinal axis of the spindle 10. As a result of this, the semi-spherical end 35 of the trailing end portion 11 of the spindle 10 is set free so that the corkscrew is ready for commencing a second phase of the operation thereof.

Now, when the handgrip 14 is further turned about the longitudinal axis of the spindle 10, the spindle 10 does not share in the turning motion of the nut 15, but rather the threaded trailing end portion 11 of the spindle 10 is advanced in the axial direction of the spindle 10 through the nut 15. In this unlocking position of the locking element 18, the upper end of the trailing end portion 11 of the spindle 10 which is provided with the semi-spherical end 35 can pass through the bore 19 of the locking element 18. During this displacement of the spindle 10 which has just been described, the cork which is in engagement with the leading end portion 12 of the spindle 10 can be extracted out of the neck of the bottle.

When the cork is pulled out of the neck of the bottle, the threaded portion 11 of the spindle 10 is removed from the bore 19 of the locking element 18 by turning the handgrip 14 in the opposite direction, upon which the locking element is pivoted by the helical torsion spring 33 back into the position which is illustrated in FIGS. 1, 2 and 3*a*.

Figure 5:
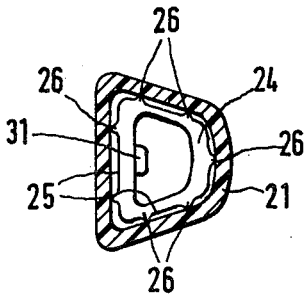
* and FIG. 5 is a sectional view of a leg of a support taken on line V—V of FIG. 1.

Even though it would be possible to construct the support 20 which has the configuration of a rectangular annulus and which is provided, at its lower end, with the supporting ring 23, of one piece, the support 20 illustrated in FIGS. 1 and 5 is constituted by two pieces. The upper piece of the support 20, or the support proper, has a U-shaped configuration and is open at its lower end. The legs 21 of the support 20 have a tubular shape and receiving openings 22 are provided at the lower ends of the U-shaped support 20. Also the supporting ring 23 has a U-shaped configuration as considered in its longitudinal section. The arms 24 of the supporting ring 23 are also tubular and have such a cross-section that they fit into the respective receiving openings 22 of the two legs 21 of the support 20, contacting the inner wall of the respective tubular leg 21.

In order to be able to rigidly connect the arms 24 with the legs 21, for instance, in a pressure fit, longitudinal ribs 26 are provided at the periphery 25 of the respective arms 24, at the region of contact of the latter with the surface bounding the respective receiving opening 22. The support 20 and the supporting ring 23 are preferably made of synthetic plastic material so that, when the support 20 and the supporting ring 23 are assembled with one another, an elastic deformation of the longitudinal ribs 26 takes place so as to constitute a good and lasting connection between the two components. Such a connection is sufficient inasmuch as the supporting force exerted by the neck of the bottle on the supporting ring 23 acts only in the direction of insertion of the arms 24 into the receiving openings 22 so that the connection of the legs 21 with the arms 24 need only be so strong as to prevent dissociation of the supporting ring 23 from the support 20 due to gravity.

The supporting ring 23 is preferably lined with an elastic ring 27. This elastic ring 27 is preferably made of a synthetic plastic material, natural or synthetic rubber, or a similar material. In the exemplary embodiment illustrated in FIG. 1, the supporting ring 23, to facilitate the assembly of the elastic ring 27 with the supporting ring 23, is provided, at its upper side, with a bore 28 which is smaller in cross-section than a bore 29 provided at the lower side of the supporting ring 23. The bore 28 preferably has such dimensions that a cork, which is extracted from a bottle neck of usual dimensions, can just pass through this bore 28.

The elastic ring 27 has a downwardly conically diverging passage 30 which registers, at its narrowest region, with the bore 28. The elastic ring 27 has such an outer diameter at its lower region that it is receivable in the bore 29 of the supporting ring 23. At least two mutually diametrally opposite tongues 31 are provided at the circumference of the elastic ring 27 which engage in recesses in the wall surrounding the bore 29 in the supporting ring 23 and thus hold the elastic ring 27 in the supporting ring 23.

The illustrated and discussed embodiment of the present invention is only an example of the embodiment of the invention and the latter is not limited thereto. Rather, a variety of different structural embodiments of the basic concept of the present invention is possible. So, for instance, it is possible to use a helical compression spring instead of the helical torsion spring 33, such compression spring being accommodated in an annular groove of the handgrip 14 or in the annular groove provided in the nut 15, abutting by one of its ends against an abutment in the respective annular groove and at its other end against an abutment connected with the locking element 15. Furthermore, it is also possible to use a tension spring instead of the compression spring, when reversing the acting direction. Furthermore, it is possible to use, instead of a steel spring, a pressure accumulator acting against an air cushion. Furthermore, rubber elastic biasing means could also be utilized. Instead of the pressure fit of the support 20 and the supporting ring 23, another connecting arrangement of conventional type could be used, such as glueing, riveting, welding or the like. Furthermore, it is also conceivable to make the support 20 together with the supporting ring 23 of two longitudinally separated half shells which are connected to one another by snap-action, glueing, welding or in some other conventional connecting procedure so as to be rigidly and undetachably connected with one another.

It will be understood that each of the elements described above, or two or more together, may also find a useful application in other types of constructions differing from the types described above.

While the invention has been illustrated and described as embodied in a corkscrew, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art, fairly constitute essential characteristics of the generic or specific aspects of this invention.

What is claimed as new and desired to be protected by Letters Patent is set forth in the appended claims.

1. A corkscrew comprising, in combination, an elongated spindle having a longitudinal axis, a cork-engaging helix at a leading end portion, and an external thread at a trailing end portion thereof; means for supporting said spindle on a respective container during turning the latter about said longitudinal axis thus displacing the same longitudinally thereof between a retracted and an extended position, including a support having an abutment surface; a threaded member having engaging portions which engage said thread of said spindle, said threaded member being a nut surrounding said trailing end portion of said spindle means for turning said threaded member about said longitudinal axis and including a pair of projections which extend radially outwardly from said nut at opposite sides thereof; a locking element mounted on said threaded member for pivoting relative thereto about a pivoting axis normal to said longitudinal axis between a locking position in which it connects said threaded member to said spindle for joint turning and displacement toward said extended position, and an unlocking position in which it releases said spindle for displacement relative to said threaded member toward said retracted position, and having an actuating portion which engages said abutment surface of said support as said spindle approaches said extended position thereof to pivot said locking element from said locking to said unlocking position; and biasing means arranged between said locking element and at least one of said projections and urging said locking element toward said locking position thereof and being tensioned by a counterforce applied thereto when said actuating portion engages said abutment surface and an operator further rotates said turning means to permit said locking element to pivot relative to said threaded member, thereby releasing said spindle for displacement thereof toward said retracted position.

2. A combination as defined in claim 1, wherein said biasing means includes a helical torsion spring having one end connected to said locking element and another end connected to said one projection.

3. A combination as defined in claim 2, wherein said one projection includes a core element rigid with said nut and a sleeve surrounding said core element and rigidly connected thereto; and wherein said other end of said torsion spring is attached to said sleeve.

4. A combination as defined in claim 1, wherein said support is substantially U-shaped having a bight and two legs extending from said bight toward said one end portion of said spindle; and wherein said supporting means further includes a supporting ring adapted to engage the respective container and mounted on free ends of said legs which are remote from said bight.

5. A combination as defined in claim 4, wherein said support is tubular and said free ends of said legs thereof have receiving openings for partly receiving said supporting ring.

6. A combination as defined in claim 5, wherein said supporting ring is substantially U-shaped in longitudinal section, having arms which are press-fittingly received in said receiving openings.

7. A combination as defined in claim 6, wherein said arms have ribs at their respective circumferences which are juxtaposed with said free ends of said legs within said receiving openings.

8. A combination as defined in claim 7, wherein said arms are elongated; and wherein said ribs extend longitudinally of said arms.

9. A combination as defined in claim 4, wherein said supporting ring includes a supporting body and an elastic ring mounted on said supporting body and adapted to contact the respective container.

10. A combination as defined in claim 9, wherein said supporting body has an inner surface which bounds an opening having a smaller cross-section remote from than at that face of said supporting body which faces the respective container; and wherein said elastic ring rests against said surface at the region of the smaller cross-section of said opening.

11. A combination as defined in claim 10, wherein said elastic ring has a passage conically converging away from said face and adapted to embrace a neck of the respective container; and wherein the smallest cross-section of said passage is smaller than that of the neck.

12. A combination as defined in claim 10, wherein said supporting body has at least one recess in said opening; and wherein said elastic ring has at least one elastically yieldable tongue engaging in said recess.

13. A corkscrew, comprising an elongated spindle having a longitudinal axis, a cork engaging helix at a leading end portion and an external thread at a trailing end portion thereof; means for supporting said spindle on a respective container for turning about said longitudinal axis, including a tubular support of substantially U-shaped cross-section having bight and two legs extending from said bight toward said leading end of said spindle, said legs being provided with receiving openings remote from said bight; a threaded member having engaging portions which engage said thread of said spindle, said threaded member being a nut surrounding said trailing end portions of said spindle; an insertable supporting ring adapted to engage the respective container and being closely received in said opening of said legs, thereby contacting an inner wall of the respective tubular leg; means for turning said threaded member about said longitudinal axis and including a pair of projections which extend radially outwardly from said nut at opposite sides thereof; a locking element mounted on said threaded member for pivoting relative thereto about a pivoting axis normal to said longitudinal axis between a locking position in which it connects said threaded member to said spindle for joint turning and displacement toward said extended position, and an unlocking position in which it releases said spindle for displacement relative to said threaded member toward said retracted position, and having an actuating portion which engages said abutment surface of said support as said spindle approaches said extended position thereof to pivot said locking element from said locking to said unlocking position; and biasing means arranged between said locking element and at least one of said projections and urging said locking element toward said locking position thereof and being tensioned by a counterforce applied thereto when said actuating portion engages said abutment surface and an operator further rotates said turning means to permit said locking element to pivot relative to said threaded member, thereby releasing said spindle for displacement thereof toward said retracted position.

* * * * *